US007900716B2

(12) United States Patent
Ibrahim et al.

(10) Patent No.: US 7,900,716 B2
(45) Date of Patent: Mar. 8, 2011

(54) VIBRATORY UNIT FOR DRILLING SYSTEMS

(75) Inventors: George Ibrahim, Mississauga (CA); Christopher L Drenth, North Bay (CA); Anthony Lachance, North Bay (CA)

(73) Assignee: Longyear TM, Inc., South Jordan, UT (US)

( * ) Notice: Subject to any disclaimer, the term of this patent is extended or adjusted under 35 U.S.C. 154(b) by 133 days.

(21) Appl. No.: 12/323,304

(22) Filed: Nov. 25, 2008

(65) Prior Publication Data

US 2009/0173542 A1 Jul. 9, 2009

Related U.S. Application Data

(60) Provisional application No. 61/018,945, filed on Jan. 4, 2008.

(51) Int. Cl.
*E21B 7/24* (2006.01)

(52) U.S. Cl. ..... 175/55; 175/56; 175/403

(58) Field of Classification Search ..... 175/106, 175/55, 56, 58, 244, 246, 249
See application file for complete search history.

(56) References Cited

U.S. PATENT DOCUMENTS 2,925,252 A * 2/1960 Minor ..... 175/95
2,970,660 A 2/1961 Bodine
3,163,240 A 12/1964 Bodine
3,406,524 A 10/1968 Blenkarn et al.
3,633,688 A 1/1972 Bodine
3,807,512 A 4/1974 Pogonowski
3,887,020 A 6/1975 Chaffin
4,279,315 A 7/1981 Tibussek
4,313,615 A * 2/1982 Simon ..... 280/432
4,518,051 A 5/1985 Sollie et al.
4,558,749 A 12/1985 Fulkerson
4,603,748 A 8/1986 Rossfelder et al.
4,660,658 A 4/1987 Gustafsson
4,667,742 A 5/1987 Bodine
4,742,721 A 5/1988 Pouillon
4,913,234 A 4/1990 Bodine
4,932,483 A 6/1990 Rear
4,940,097 A 7/1990 Martini
4,958,691 A 9/1990 Hipp
5,027,908 A 7/1991 Roussy
5,107,944 A 4/1992 Gustafsson
5,115,875 A 5/1992 Ennis
5,156,223 A 10/1992 Hipp
5,351,765 A 10/1994 Ormsby
5,355,964 A 10/1994 White
5,494,119 A 2/1996 Tully
5,562,169 A 10/1996 Barrow
5,601,152 A 2/1997 Harrison
5,788,401 A 8/1998 Drenth
5,803,187 A 9/1998 Javins
6,109,620 A 8/2000 Roberts et al.
6,125,952 A 10/2000 Beccu et al.

(Continued)

*Primary Examiner* — Shane Bomar
*Assistant Examiner* — Kipp C Wallace
(74) *Attorney, Agent, or Firm* — Workman Nydegger

(57) ABSTRACT

A down-the-hole vibratory unit for a drilling system includes a casing comprising a fluid inlet. The vibratory unit can also include a plurality of eccentrically weighted rotor assemblies positioned at least partially within the casing and in fluid communication with the inlet. The eccentrically weighted rotor assemblies can be unbalanced relative to a central axis. Additionally, the eccentrically weighted rotor assemblies can be configured to rotate in response to a fluid flow directed thereto to apply centrifugal forces to the casing.

24 Claims, 8 Drawing Sheets

U.S. PATENT DOCUMENTS

| | | | |
|---|---|---|---|
| 6,152,222 | A | 11/2000 | Kyllingstad |
| 6,182,776 | B1 | 2/2001 | Asberg |
| 6,196,598 | B1 | 3/2001 | Yao |
| 6,209,666 | B1 | 4/2001 | Beccu et al. |
| 6,386,301 | B1 | 5/2002 | Rear |
| 6,502,650 | B1 | 1/2003 | Beccu |
| 7,195,069 | B2 | 3/2007 | Roberts |
| 2002/0011360 | A1 | 1/2002 | Gien |
| 2005/0011680 | A1 | 1/2005 | Egerstrom |
| 2005/0045385 | A1 | 3/2005 | Stjernstrom et al. |
| 2006/0054322 | A1 | 3/2006 | Rose |
| 2006/0175093 | A1 | 8/2006 | Mocivnik et al. |
| 2006/0180352 | A1 | 8/2006 | Mocivnik et al. |
| 2006/0214041 | A1 | 9/2006 | Yao et al. |

* cited by examiner

VIBRATORY UNIT FOR DRILLING SYSTEMS

CROSS-REFERENCE TO RELATED APPLICATIONS

This application claims the benefit of U.S. Provisional Patent Application Ser. No. 61/018,945 filed Jan. 4, 2008, which is hereby incorporated by reference in its entirety.

BACKGROUND OF THE INVENTION

1. The Field of the Invention

The present invention relates to drilling systems and to down-hole vibratory units in particular.

2. The Relevant Technology

Core drilling allows samples of subterranean materials from various depths to be obtained for many purposes. For example, drilling a core sample and testing the retrieved core helps determine what materials are present or are likely to be present in a given formation. For instance, a retrieved core sample can indicate the presence of petroleum, precious metals, and other desirable materials. In some cases, core samples can be used to determine the geological timeline of materials and events. Accordingly, core samples can be used to determine the desirability of further exploration in a given area.

Although there are several ways to collect core samples, core-barrel systems are often used for core sample retrieval. Core-barrel systems include an outer tube with a coring drill bit secured to one end. The opposite end of the outer tube is often attached to a drill string that extends vertically to a drill head that is often located above the surface of the earth. The core-barrel systems also often include an inner tube located within the outer tube. As the drill bit cuts formations in the earth, the inner tube can be filled with a core sample. Once a desired amount of a core sample has been cut, the inner tube and core sample can be brought up through the drill string and retrieved at the surface.

While such a configuration allows for the retrieval of core samples, the core sample can occasionally become jammed. For example, when using a core-barrel system to retrieve core samples in formations that contain unconsolidated or blocky ground, the core sample can jam or become lodged within the inner tube. This jamming can cause the weight of the drill string to be transferred substantially away from the outer tube to the core sample and the inner tube. This weight transfer can cause the core sample to fracture, which in turn can cause the slow or stop the core drilling operation entirely. Even if drilling continues, the head of the core sample in the bit can mill the formation and render that portion of the formation permanently unrecoverable. Thus, a core sample that is jammed in the inner tube can slow the drilling process and reduce the overall productivity of the drilling process.

The subject matter claimed herein is not limited to embodiments that solve any disadvantages or that operate only in environments such as those described above. Rather, this background is only provided to illustrate one exemplary technology area where some embodiments described herein can be practiced

BRIEF SUMMARY OF THE INVENTION

A down-the-hole vibratory unit for a drilling system includes a casing comprising a fluid inlet, and a plurality of eccentrically weighted rotor assemblies positioned at least partially within the casing and in fluid communication with the inlet, the eccentrically weighted rotor assemblies that are unbalanced relative to a central axis and are configured to rotate in response to a fluid flow directed thereto to apply centrifugal forces to the casing.

A core barrel vibratory unit can include a casing comprising a fluid inlet and a fluid outlet, a fluid-driven vibrating mechanism that produces vibrations in a drilling direction without producing any substantial vibrations in a non-drilling direction by rotating multiple rotors that are each unbalanced about a central axis, and a damping mechanism that reduces or eliminates the vibrations before they are transmitted to another part of a drilling system to which the vibrating mechanism is connected.

Additional features and advantages of the invention will be set forth in the description which follows, and in part will be obvious from the description, or can be learned by the practice of the invention. The features and advantages of the invention can be realized and obtained by means of the instruments and combinations particularly pointed out in the appended claims. These and other features of the present invention will become more fully apparent from the following description and appended claims, or can be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1:
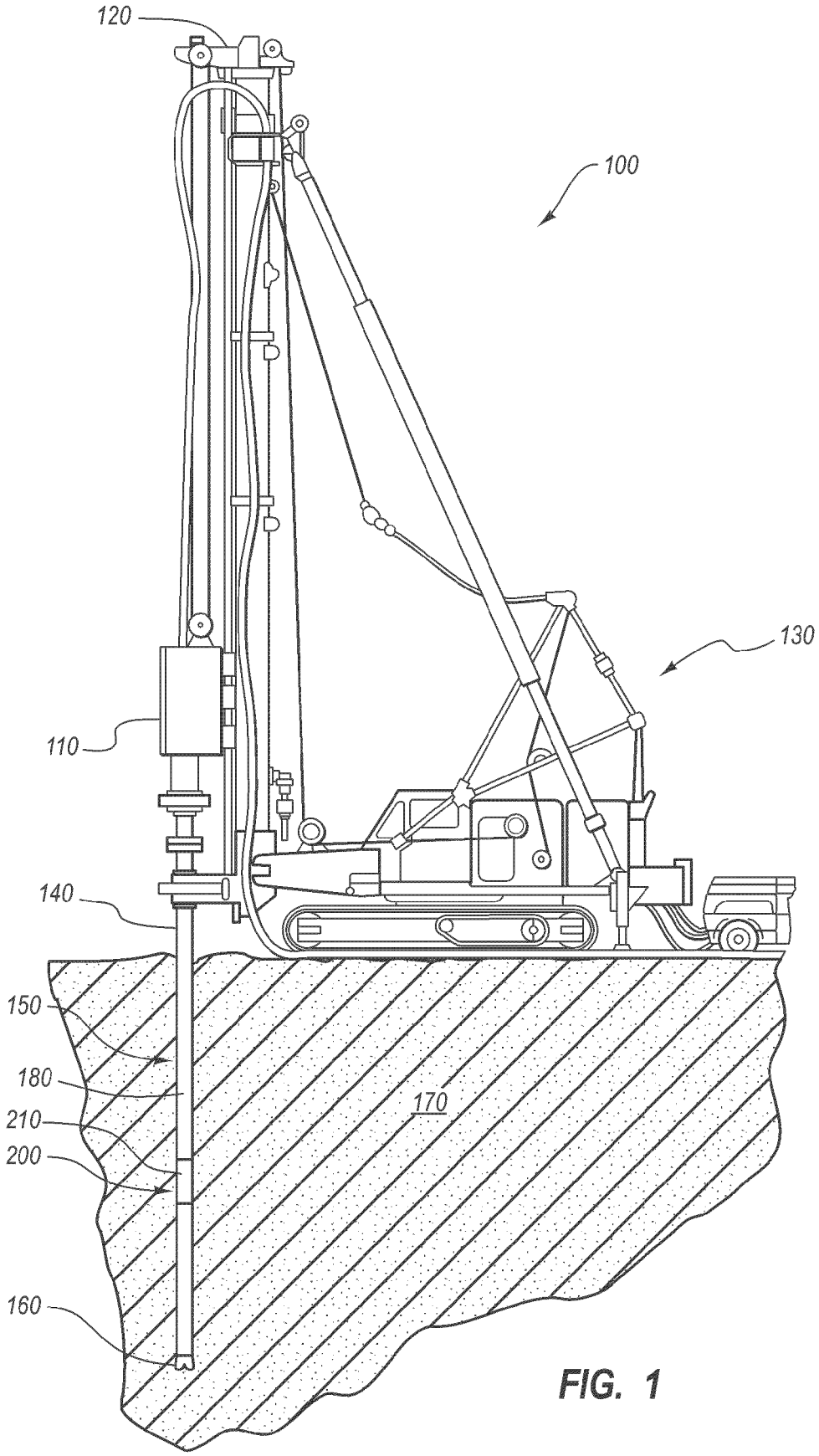
FIG. 1 illustrates a vibratory unit and associated drilling system according to one example.

The figures illustrate specific aspects of the vibratory unit and the associated methods of making and using such a unit. Together with the following description, the figures demonstrate and explain the principles of vibratory unit and these associated methods. In the Figs., the thickness and configuration of components can be exaggerated for clarity. The reference numerals in different figures represent similar, though not necessarily identical, components.

DETAILED DESCRIPTION OF THE PREFERRED EMBODIMENTS

Systems, devices, and methods are provided herein for sampling a formation. In at least one example, a vibratory unit is provided that includes eccentrically weighted rotors. Due to the eccentric weighting of the rotors, as the rotors rotate they generate centrifugal forces. The rotors may be oriented and positioned in such a manner that axial components of the centrifugal forces sum together while radial components cancel each other. Such a configuration can allow a vibratory unit to generate axial, cyclically oscillating centrifugal forces, or axial vibratory forces. These forces can be transmitted to other components of a drilling system, such as a core barrel. The application of axial vibratory forces to a core-barrel system may reduce the possibility that a core barrel will become jammed as the core barrel retrieves a sample from an unconsolidated or loose formation.

The following description supplies specific details in order to provide a thorough understanding. Nevertheless, the skilled artisan would understand that the vibratory unit and methods of making and using the device can be implemented and used without employing these specific details. Indeed, the vibratory unit and associated methods can be modified and used in conjunction with any apparatus, systems, components, and/or techniques used in the drilling field. Additionally, while the description below focuses on implementing the vibratory unit with core-barrel systems used to retrieve core samples in unconsolidated or blocky ground, the vibratory unit can be implemented in core-barrel systems used to retrieve core samples from any desired formation, including fragmented, consolidated, soft, conglomerated, sandy, wet, and clay formations. Indeed, the vibratory unit could be used in any down-the-hole application.

FIG. 1 illustrates a drilling system 100 that includes a drill head 110. The drill head 110 can be coupled to a mast 120 that in turn is coupled to a drill rig 130. The drill head 110 is configured to have a drill rod 140 coupled thereto. The drill rod 140 can in turn couple with additional drill rods to form a drill string 150. In turn, the drill string 150 can be coupled to a drill bit 160 configured to interface with the material to be drilled, such as a formation 170.

In at least one example, the drill head 110 illustrated in FIG. 1 is configured to rotate the drill string 150 during a drilling process. In particular, the rotational rate of the drill string 150 can be varied as desired during the drilling process. Further, the drill head 110 can be configured to translate relative to the mast 120 to apply an axial force to the drill head 110 to urge the drill bit 160 into the formation 170 during a drill process. The drilling system 100 also includes a down-the-hole assembly, such as a core-barrel assembly 200. The down-the-hole assembly 200 includes or has a vibratory unit 210 coupled thereto. In at least one example, the vibratory unit 210 can be located down the borehole between the drill string 150 and the drill bit 160.

The vibratory unit 210 provides a vibratory force relative to at least one direction. For example, the vibratory unit 210 can be configured to provide an axial vibratory force to a down-hole component, such as a core barrel, a radial vibratory force generally perpendicular to the down-hole component, a vibratory force in some other direction, and/or combinations thereof. For ease of reference, the vibratory unit 210 unit will be described as applying an axial force to the core barrel assembly 200 and/or the drill string 150.

In at least one example, the drill head 110, the drill rig 130, and/or some other unit can include a pressure generator. The pressure generator can be configured to pressurize a fluid to provide motive power to drive the vibratory unit 210, as will be described in more detail below. In at least one example, the fluid can include water or other liquids, indicated by waterline 180.

While one configuration is illustrated, it will be appreciated that the vibratory unit 210 can be located at any position along the drill string 150. Further, while one type of motive power will be described, it will be appreciated that other types of motive power can be provided in any suitable manner, such as by hoses or other devices that are coupled to the vibratory unit 210. Further, while a core barrel assembly 200 is described, it will be appreciated that the vibratory unit 210 can be part of and/or coupled to any number of down-the-hole assemblies.

Figure 2A:
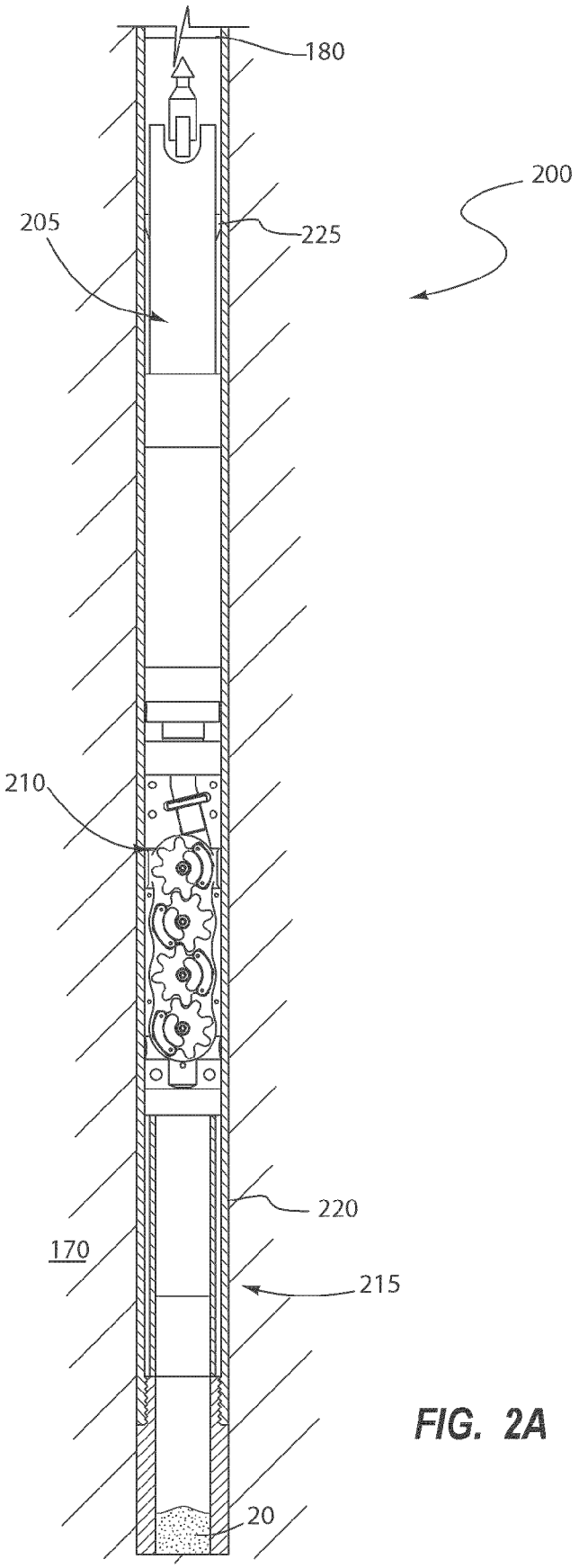
FIG. 2A illustrates a down-hole assembly according to one example.
Figure 2B:
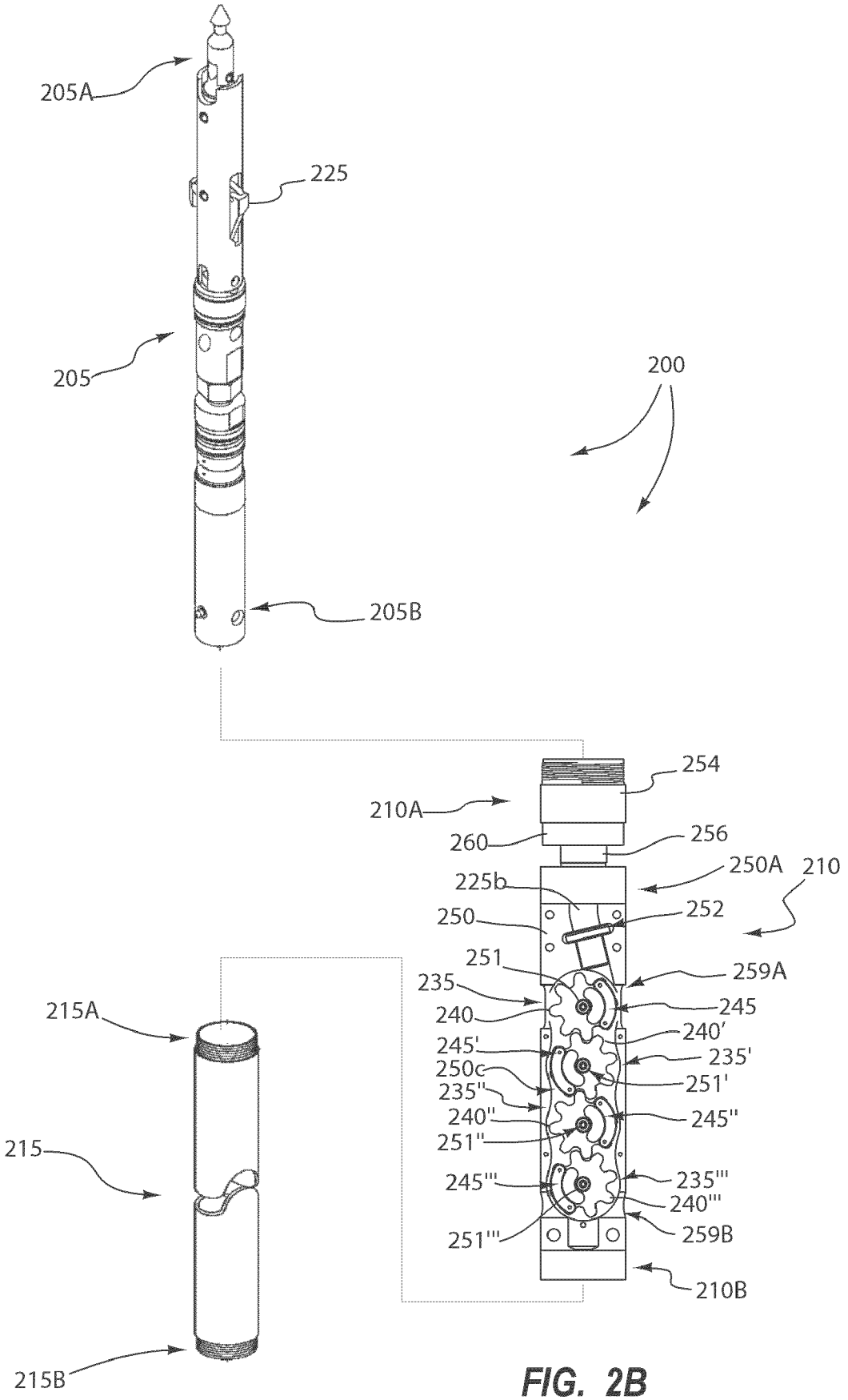
FIG. 2B illustrates an exploded view of the down-hole assembly of FIG. 2A.

FIGS. 2A-2B illustrates the core-barrel assembly 200 in more detail. In particular, FIG. 2A illustrates the core-barrel assembly 200 positioned within a formation 170 while FIG. 2B illustrates an isolated, exploded view of the core-barrel assembly 200. As illustrated in FIG. 2A, the core-barrel assembly 200 includes a head assembly 205, the vibratory unit 210, and a core-lifter assembly 215.

In the illustrated example, the core-barrel assembly 200 can be a wire-line type core-barrel assembly. Accordingly, the head assembly 205, the vibratory unit 210, and the core lifter assembly 215 can be located at least partially within an outer tube 220. The drill bit 160 can in turn be coupled secured to the outer tube 220 such that as the outer tube 220 rotates the drill bit 160 also rotates.

As illustrated in FIG. 2B, the head assembly 205 includes a head end 205A and a bit end 205B, the vibratory unit 210 includes a head end 210A and a bit end 210B, and the core-lifter assembly 215 includes a head end 215A and a bit end 215B. In the illustrated example, the core-barrel assembly 200 is wire-line type core-barrel assembly. Accordingly, the head end 205A of the head assembly 205 can include a spear-point assembly that is configured to engage an overshot. The head assembly 205 can further include latches 225.

As illustrated in FIG. 2A, the latches 225 are configured to be deployed to thereby secure the core-barrel assembly 200 to the outer tube 220. Such a configuration causes the core-barrel assembly 200 to rotate with the outer tube 220. As the outer tube 220 rotates, it forces the drill bit 160 into the formation 170. As the drill bit 160 rotates, the drill bit 160 cuts the formation 170 thereby forcing a core-sample 20 into the core-lifter assembly 215.

As a core-sample is forced into the core-lifter assembly 215, the vibratory unit 210 applies a vibratory force to at least the core-lifter assembly 215 in at least one direction to thereby help ensure the core sample does not become jammed within the core-lifter assembly 215. As previously introduced, the vibratory unit 210 can be powered by any motive force desired.

Referring again to FIG. 2B, the vibratory unit 210 can include one or more eccentrically weighted rotor assemblies (rotor assemblies) 235, 235', 235'', 235'''. As previously introduced, the rotor assemblies 235-235''' can be eccentrically weighted. The rotor assemblies 235-235''' can be weighted eccentrically in any manner. One or more of the rotor assemblies 235-235''' includes a gear 240'-240'''. Further, at least one of the rotor assemblies 235-235''' includes at least one eccentric weight assembly 245-245''' coupled to one of the gears 240-240'''.

In the illustrated example, eccentrically weight assemblies 245-245''' are associated with the gears 240-240''' respectively. As will be described in more detail below, the eccentric weight assemblies 245-245''' cause the rotor assemblies 235-235''' to rotate in an unbalanced manner to transmit vibratory forces to at least a portion of the core-barrel assembly 200 (FIG. 2B). While one configuration is illustrated that includes separate eccentric weight assemblies 245-245''' coupled to a corresponding gear 240-240''', it will be appreciated that the eccentric weight assemblies 245-245''' can be integrally formed with the gears 240-240'''. Further, the eccentric weight assemblies 245-245''' can be coupled to the gears 240-240''' in any manner. Additionally, any number of eccentric weight assemblies 245-245''' can be coupled to any of the gears 240-240'''.

The gears 240-240''' are operatively associated with a casing 250. In particular, the gears 240, 240''' can be positioned within a compartment 250C and can rotate about pin assemblies 251-251''' that are secured to the casing 250. FIG. 2B illustrates that, for example, the compartment 250C can be contoured so as to limit space between the compartment 250C and the rotor assemblies 235-235''' so as to limit flow around the rotor assemblies 235-235'''. In this way, a path of least resistance is created to maximize the amount of fluid that comes in contact with the unbalanced rotors in the desired flow direction.

Further, the rotor assemblies 235-235''' are positioned within the casing 250 in such a manner that rotor assembly 235 engages rotor assembly 235', which in turn engages rotor assembly 235'', which in turn engages rotor assembly 235'''. In particular, gear 240 meshes with gear 240', which in turn meshes with gear 240'', which in turn meshes with gear 240'''. As a result, gear 240-240''' can form a gear chain such that rotation of one gear result in rotation of one or more of the other gears.

With continued reference to FIG. 2B, the vibratory unit 210 can include a nozzle 252 positioned in the casing 250 and in fluid communication with rotor assembly 235. As a result, fluid passing through the nozzle 252 is directed to rotor assembly 235. The incidence of the fluid on rotor assembly 235 causes the rotor assembly 235, including the gear 240 to rotate in the direction indicated by the arrow. The vibratory unit 210 can function in any manner that allows the vibratory unit 210 to vibrate and transmit a vibration to another component, such as the core-lifting assembly 215. Typically, as a fluid travels down the inside of the drill string, the fluid enters the head end 210A of the vibratory unit 210. Although any liquid or gas (both referred to as fluid) used in core drilling can enter the vibratory unit 210, some non-limiting examples of typical fluids can include water, polymer-based drilling fluid, drilling mud, pneumatic gas, or combinations thereof.

Engagement between the gears 240-240''' as described above causes the rest of the gears 240'-240''' to rotate in response to rotation of gear 240. In particular, the vibratory unit 210 includes a connecting joint 254. The connecting joint 254 can be configured to be coupled to a bit end of an upstream component, such as the bit end 205B of the head assembly 205. A damper shaft 256 is seated relative to and extends at least partially through and beyond the connecting joint 254. The damper shaft 256 is also in fluid communication with a head end 250A of the casing 250 and with a channel 258 defined in the head end 250A in particular. The channel 258 in turn is in fluid communication with the nozzle 252.

As a result, a fluid flow entering the vibratory unit passes through the connecting joint 254, the damper shaft 256 and the channel 258 where it is then directed to the nozzle 252. From the nozzle 252 is incident on one or more of the rotor assemblies 235-235''' to cause the rotor assemblies 235-235''' to rotate as described above. The fluid can be outlet from the vibratory unit in any manner desired. For example, the casing can include one or more outlets in communication with the compartment 250C in the casing 250 described above. These outlets can include head end outlets 259A and bit end outlets 259B. Accordingly, fluid directed to the vibratory unit 210 can escape through the outlets 259A, 259B as the rotor assemblies 235-235''' rotate.

The eccentric weighting of the rotor assemblies 235-235''' due to the eccentric weight assemblies 245-245''' results in an unbalanced centrifugal force acting away from a center of the rotor assemblies 235-235'''. Continued rotation of the rotor assemblies 235-235''' results in a cyclical force in one or more direction. This cyclical force can be transmitted to other portions of the core-barrel assembly 200, such as core-lifter assembly 215. For ease of reference, one configuration of the vibratory unit 210 will be discussed in which the cyclical force is transmitted primarily in an axial direction. It will be appreciated that other configurations are possible to transmit the cyclical force in a desired direction, such as a radial direction, angular directions, or combinations thereof.

FIGS. 3A-3D illustrate the vibratory unit 210 as the rotors 235-235''' in first, second, third, and fourth positions as the rotors 235-235''' move through a complete revolution in which the first position is an initial position and each of the subsequent positions represent approximately 90 degrees of rotation of each of the rotor assemblies 235-235'''. In FIGS. 3A-3D, centrifugal forces acting on the rotor assemblies 235-235''' are represented generally as F-F''' respectively. The centrifugal forces can further be characterized as including an axial component that acts parallel to the drilling direction and a radial component that acts perpendicular to the axial component.

Figure 3A:
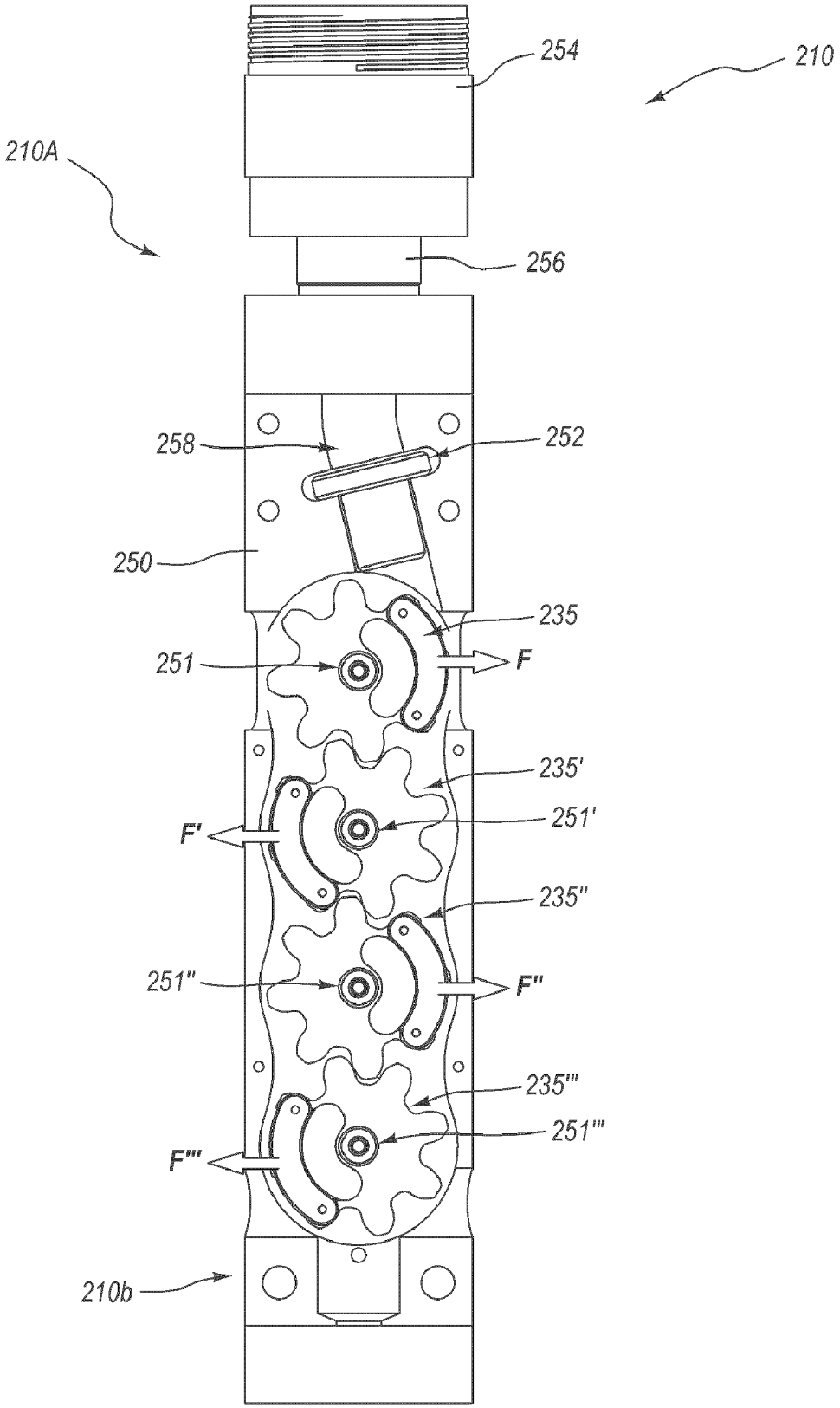
FIG. 3A illustrates a vibratory unit with unbalanced rotors in a first position according to one example.

As illustrated in FIG. 3A, the radial component of the centrifugal forces F-F''' are the primary components. Further, as illustrated in FIG. 3A, the radial component of forces F and F'' act in a radially opposite direction as centrifugal forces F' and F'''. Accordingly, in the first position the centrifugal forces and the radial components in particular, cancel one another. As the rotor assemblies 235-235''' move toward the position in FIG. 3B, rotor assemblies 235 and 235'' move in the opposite direction of rotor assemblies 235' and 235'''. As a result, the radial component of centrifugal forces F-F''' will continue to cancel each other out. While the radial component of the centrifugal forces F-F''' act opposite each other to cancel each other, the axial components of the centrifugal forces F-F''' act in the same direction as the rotor assemblies 235-235''' rotate toward the positions illustrated in FIG. 3B.

Figure 3B:
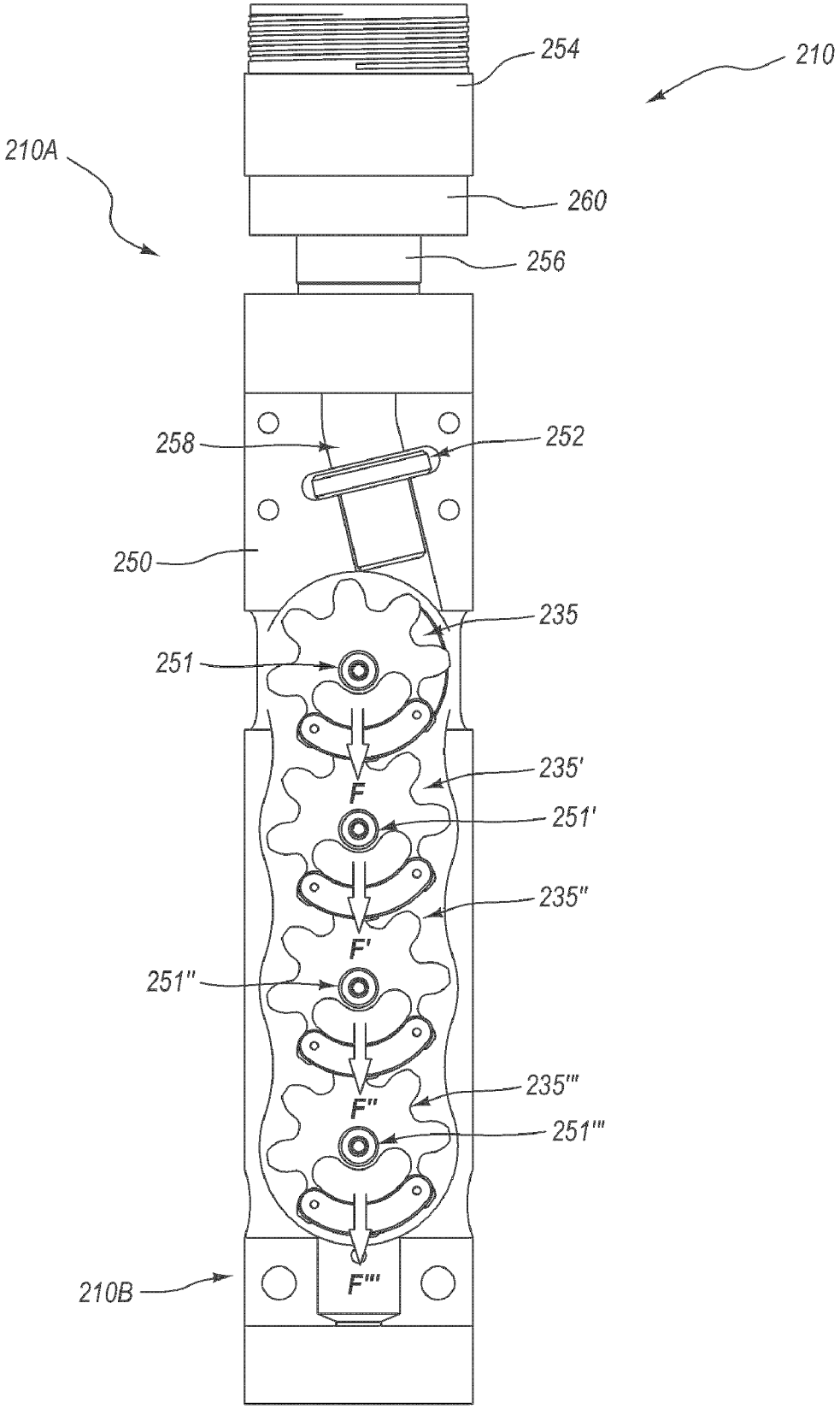
FIG. 3B illustrates the vibratory unit of FIG. 3A with the unbalanced rotors in a second position.

The axial components of the centrifugal forces F-F''' increase to a maximum value while the radial components are at a minimum value, such as when the rotor assemblies 235-235''' are at the position shown in FIG. 3B. In the position shown in FIG. 3B, the centrifugal forces F-F''' act axially toward the bit end 210B. As previously introduced, pin assemblies 251 couple the rotor assemblies 235-235''' to the casing 250. The pin assemblies 251 further transmit the centrifugal forces F-F''', and the axial components in particular, to the casing 250. The casing 250 in turn transmits the centrifugal forces F-F''' to other components, including the core-lifting assembly 215 (FIG. 2A).

Figure 3C:
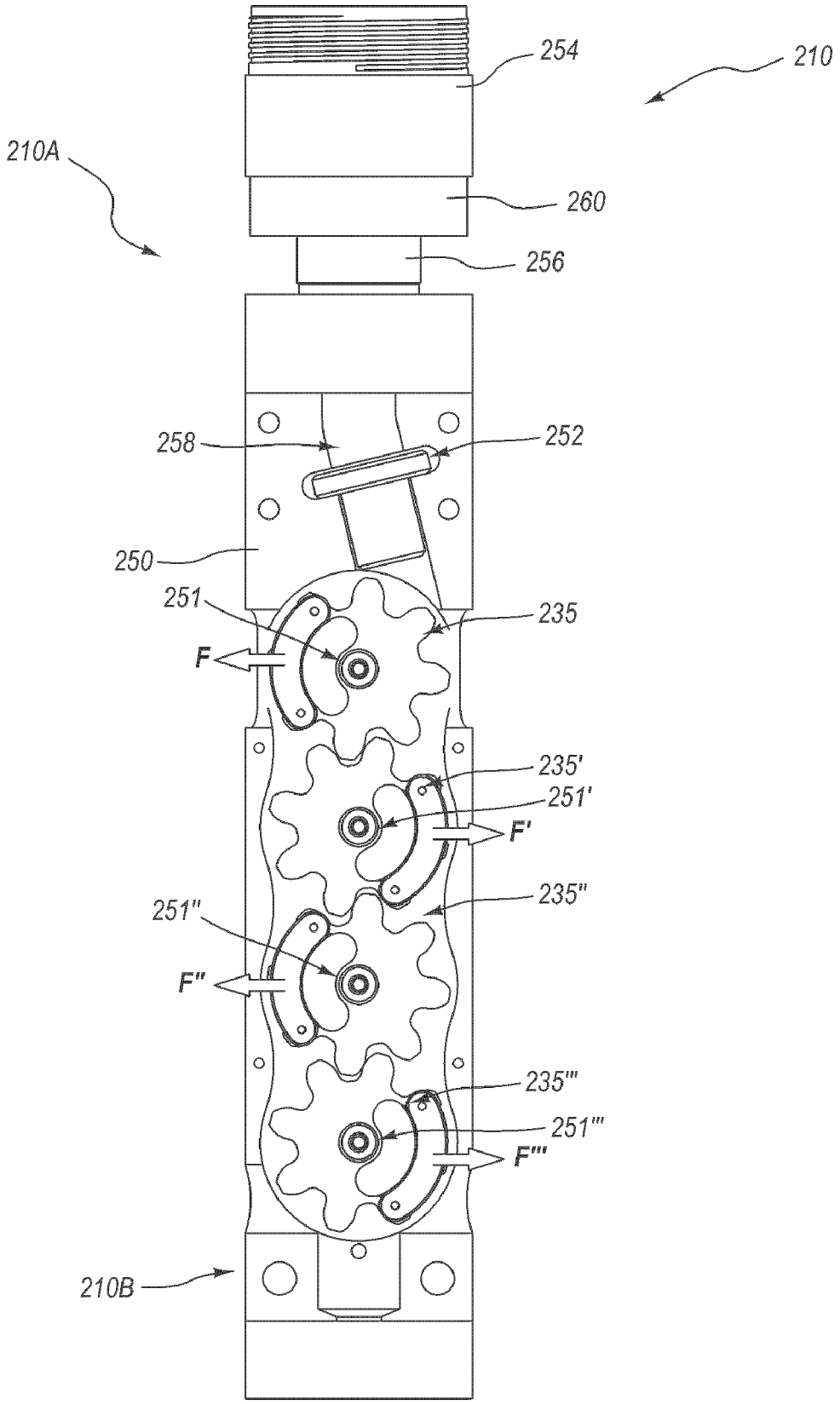
FIG. 3C illustrates the vibratory unit of FIGS. 3A-3B with the unbalanced rotors in a third position.

As the rotor assemblies 235-235''' rotate to the third position illustrated in FIG. 3C, the axial components of the centrifugal forces F-F''' decrease while the radial components increase to a maximum value at the position shown in FIG. 3C. As previously introduced, while the radial components of the centrifugal forces F-F''' increase they are in opposite directions and can be generally equal so as to cancel each other out. As a result, while the rotor assemblies 235-235''' are at the position shown in FIG. 3C, the centrifugal forces F-F''' cancel each other out while at a maximum.

Figure 3D:
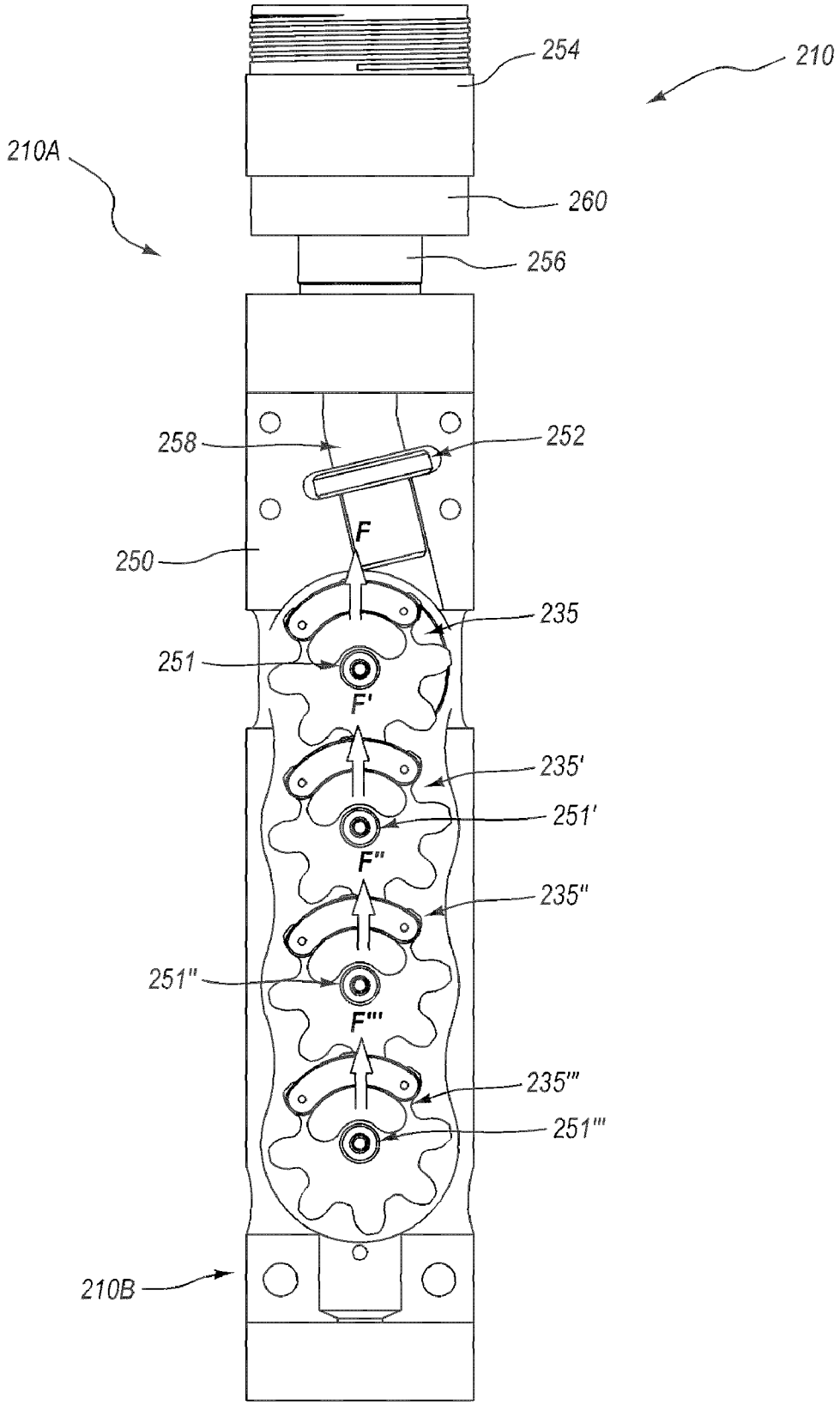
FIG. 3D illustrates the vibratory unit of FIGS. 3A-3C with the unbalanced rotors in a fourth position.

As the rotor assemblies 235-235''' continue to rotate to the position shown in FIG. 3D, the radial components of the centrifugal forces F-F''' will continue to cancel each other out as they decrease while the radial components will increase. The radial components act together axially toward the head end 210A. The axial components will decrease and the radial components will increase and cancel each other out as the rotor assemblies 235-235''' return to the position shown in FIG. 3A.

Accordingly, in at least one example, axial components of the centrifugal forces F-F''' generated due to unbalanced rotation of the rotor assemblies 235-235''' will oscillate between a maximum force directed toward the bit end 210B and a maximum force directed toward the head end 210A while radial components of the centrifugal forces F-F''' substantially cancel one another. Accordingly, rotation of the rotor assemblies 235-235''' results in cyclical axial forces. The cyclical axial forces can also be described as vibratory forces. In some example, it can be desirable to transmit the vibratory forces axially toward the head end 210A and the bit end 210B.

In other examples, it can be desirable to transmit the axial forces to components to one of the head end 210A or the bit end 210B and to isolate other components from axial forces in the other direction. Accordingly, it can be desirable for the vibratory unit 210 to damp axial forces. In at least one example, the vibratory unit 210 can include means for damping or isolating forces that would otherwise be transmitted in a selected direction, such as toward the head assembly 205 (FIG. 2B). In the illustrated example, the damping means includes at least one shock absorber 260 located at least partially between the inlet joint 254 and the casing 250. Means for damping forces can also include vibratory isolators, pads, dampers, damping shaft, rubber bushings, shock absorbers, grommets, crash stops, gaskets, seals, and/or other suitable components that damp, isolate, and/or absorb vibration. Additionally, the components of the damping mechanism can be made of any suitable material that damps vibration. Some non-limiting examples of vibration damping materials can include one or more rubbers, polymers, composites, etc.

Further, the damping means can be disposed in any desired location, such as any location that allows the mechanism to damp vibrations before they reach the latches 225 in the core barrel head assembly 200 (both shown in FIGS. 2A and 2B). In the illustrated example, the shock absorber 260 and/or other damping components are substantially exposed from the casing 250. In other examples, the damping mechanism can be substantially disposed within the casing 250. In still other embodiments, however, a portion of the damping mechanism can be disposed within the casing 250 while another portion of the damping mechanism is exposed from the casing 250.

Figure 4:
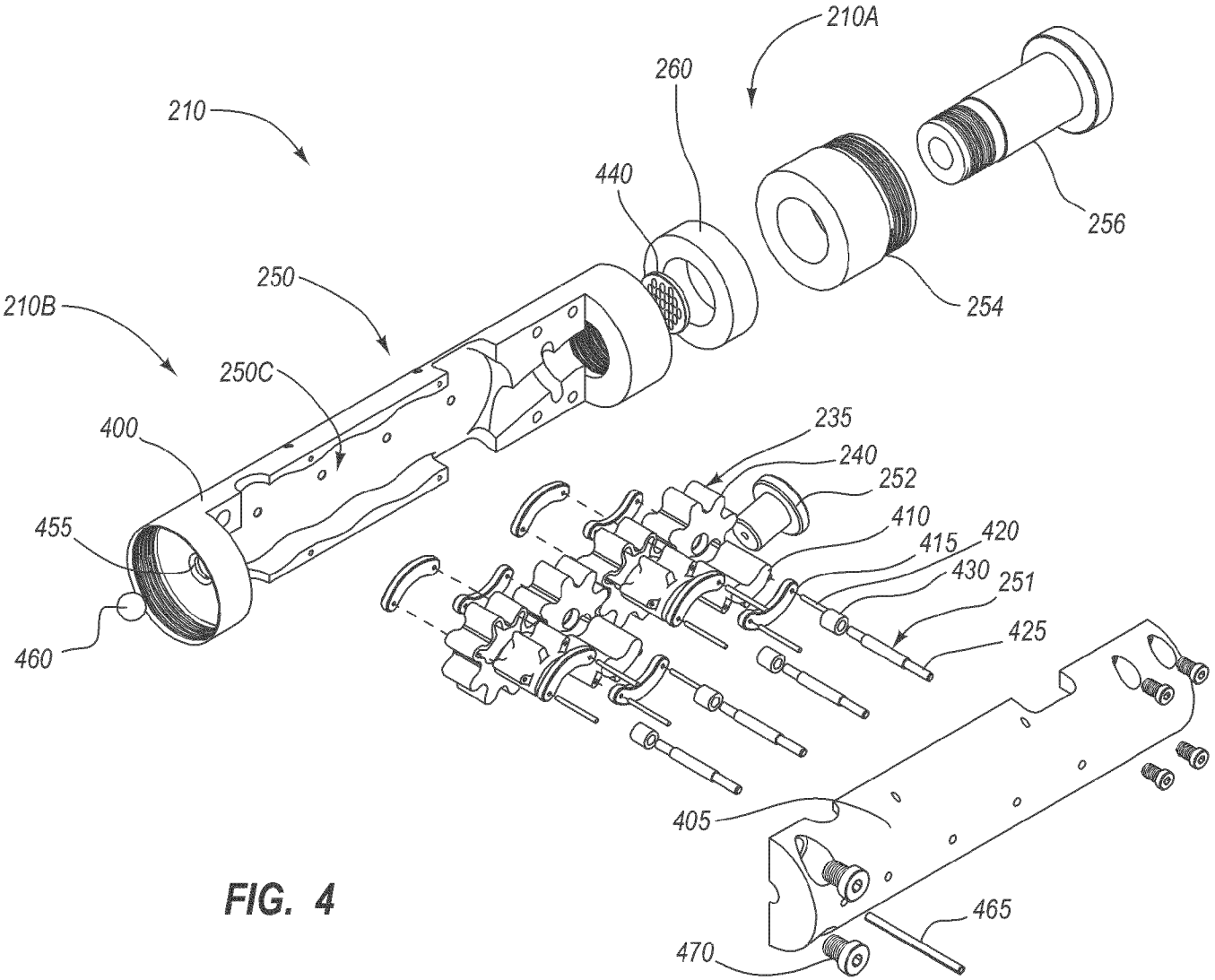
FIG. 4 illustrates an exploded view of a vibratory unit according to one example.

FIG. 4 illustrates additional components of the vibratory unit 210 in more detail. These components and their assembly will now be described in more detail. In the illustrated example, the casing 250 includes a main body 400 and a cover 405. Further, as illustrated in FIG. 4, each of the rotor assemblies 235-235''' can be substantially similar. Accordingly, in at least one example the discussion of rotor assembly 235 can be applicable to rotor assemblies 235'-235'''.

In the illustrated example, rotor assembly 235 includes gear 240, an eccentric weight 410 and one or more insert 415. The inserts 415 can be secured to the eccentric weight 410 and the gear 240 in suitable manner, such as by way of spring pins 420. The gear 240 and the eccentric weight 410 can have complimentary shapes that allow the gear 240 to receive at least a portion of the eccentric weight 410. One such shape of the gear 240 includes a recessed gear. Such a configuration may increase the weight eccentricity of the rotor assembly 235 as a relatively large percentage of the rotor assembly 235 may be associated with the eccentric weight 410 and the inserts 415.

As previously introduced, the rotor assembly 235 is configured to rotate about pin assemblies 251. The pin assembly 251 shown includes a shaft 425 and a roller bearing 430. The shaft 425 can be secured to the casing 250 as described above. The roller bearings 430 may reduce the friction associated with rotation of the rotor assembly 235 in response to a fluid flow.

The vibratory unit 210 may also include a filter screen 440 placed upstream of the rotor assemblies 235-235'''. The filter screen 440 may be configured to capture particulates within the fluid stream to prevent the particulates from entering the recess in the casing 250. As previously introduced, the casing 250 may include outlets defined therein. In addition to providing an inlet to drive the rotor assemblies 235-235''', an inlet 455 may be provided in the bit end 210B. The inlet 455 can have a ball 460 associated therewith to form a check valve. The ball 460 is maintained in proximity with the inlet 455 by way of a check valve pin 465. With such a configuration, the ball 460 remains in contact with the inlet 455 as fluid enters from the head end 210A but is moved out of contact with the hole when fluid is introduced from the bit end 210B. By allowing fluid to flow through the compartment 250C, the ball 460 and inlet 455 can operate as a check valve to decrease resistance and allow the core barrel assembly 200 to travel through the drill string faster and easier. When the head assembly 205 and vibratory unit 210 are being retrieved, the check valve can also prevent fluid from exerting pressure down on the proximal end of the core sample. In this manner, the check valve can help avoid causing a core sample to be dislodged and lost from the core lifting assembly 215. Instead, the check valve can force fluid to exit through the fluid outlet(s) 259A, 259B located on the sides of the vibratory unit 210. The fluid can then flow around the outside of the core lifting assembly 215 and vibratory unit 210 without dislodging the core sample.

In at least one example, each of the components described above may be separately formed through any desired process. Once the individual components have been prepared they may be assembled as desired. For example, the rotor assemblies 235-235''' may be assembled and then have the pin assemblies 251 coupled thereto. The rotor assemblies 235-235''' and the pin assemblies may then be positioned relative to the main body 400. The nozzle 252 can also be positioned relative to the main body 400, such that the nozzle 252 is in communication with the channel 258. The ball 460 may also be positioned relative to the main body 400. Thereafter, the cover 405 can be secured to the main body 400 to form the assembled casing 250. The filter screen 440 can then be positioned relative to the head end 250A of the casing, after which the damper shaft 256 can be passed through the inlet joint 254 and the shock absorber 260 and into engagement with the head end 250A of the casing. The vibratory unit 210 and its constituent components can be made in any suitable manner. For example, the various components of the vibratory unit 210 can be molded, extruded, stamped, etc. Additionally, the various components of the vibratory unit 210 can be connected to each other in any appropriate manner. Some non-limiting examples of methods for connecting the components of the vibratory unit 210 can include mechanically fastening, welding, clampingly fastening, or otherwise fastening the components together to form an assembled vibratory unit 210. For example, FIG. 4*a* depicts that fasteners 465, as well as the threaded connector joints can be used to connect the components of the vibratory unit 210 together. While such steps are described, they are provided by way of illustration only and not by way of limitation.

Further, the casing 250 can have any characteristic or component that allows the vibratory unit to be connected to a drill system, including a core barrel assembly and to vibrate within the inner tube so that the core sample is aided to slide up within the inner tube. For instance, the casing 250 can be any shape that allows the casing 250 to house the rotor assemblies 235A and still fit within the outer tube 200 (FIG. 2A). In some non-limiting examples, the casing 250 can be substantially cylindrical. For example, the exploded view of the vibratory unit 210 in FIG. 4 illustrates that the casing 250 can be substantially cylindrical in shape. In some embodiments, the casing 250 can have a diameter that is substantially smaller than the diameter of the core-lifting assembly 215 and/or head assembly 205. Further, the casing 250 can be any length that allows the casing 250 to house one or more rotor assemblies 235. While one example is illustrated, it will be appreciated that the casing 250 can comprise more or less pieces than are illustrated in the Figures and that the casing 250 can be split in any manner desired.

The vibratory unit 210 can comprise any fluid-driven mechanism that produces dynamic forces in the desired drilling direction. In the embodiments illustrated in the Figures, the fluid-driven vibrating mechanism can comprise one or more unbalanced rotors, or rotors that are unbalanced about their central axis or a central point of the rotor assembly 235 about which the rotor rotates. Some non-limiting examples of suitable rotors can include waterwheels, turbines, the aforementioned gear rotors, or any other mechanism comprising a rotor with vanes, buckets, blades, paddles, etc. where the mechanism is driven by the pressure, momentum, and/or reactive thrust of a moving fluid, occurring as the fluid passes through and/or fills the compartment 250C around the rotor. Further, the vibratory unit 210 can have any number of rotors that are unbalanced about their central axis 130 (shown in FIG. 1). For example, the vibrating mechanism can comprise as few as 1 or 2 unbalanced rotors, or as many unbalanced rotors as the hole depth allows.

Similarly, rotor assemblies 235-235''' can have any unbalanced characteristic that allows one section of the rotor to weigh more than another. Some non-limiting examples of rotor characteristics that can cause an unbalance in the rotor can include connecting or forming the previously mentioned offset weight on one section of the rotor; forming a section of the rotor with a heavier material than the material used to form the rest of the rotor; having one section of the rotor contain more material than the rest of the rotor contains; or removing material from one section of the rotor.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A down-the-hole vibratory unit for a drilling system, comprising:

a casing comprising of a fluid inlet; and a plurality of eccentrically weighted rotor assemblies positioned at least partially within the casing, the eccentrically weighted rotor assemblies being in fluid communication with the inlet, wherein:

the eccentrically weighted rotor assemblies are unbalanced relative to a central axis of the casing, the eccentrically weighted rotor assemblies comprise gears with interacting teeth, the eccentrically weighted rotor assemblies are configured to rotate as fluid flows from the inlet, directly across the eccentrically weighted rotor assemblies, and rotation of the eccentrically weighted rotor assemblies impart axial vibratory forces to the casing.

2. The vibratory unit of claim 1, wherein the gears of the eccentrically weighted rotary assemblies each include a weight secured to a side thereof.

3. The vibratory unit of claim 2, wherein the gears interact to form a gear chain.

4. The vibratory unit of claim 1, wherein the eccentrically weighted rotor assemblies are oriented relative such that axial components of the centrifugal forces sum and radial components of the axial forces cancel.

5. The vibratory unit of claim 1, further comprising a damping assembly coupled to the casing.

6. The vibratory unit of claim 5, wherein the damping assembly is positioned near a head end of the vibratory unit.

7. The vibratory unit of claim 1, wherein the eccentrically weighted rotary assemblies include an unbalanced section that are placed in diametric opposition to an unbalanced section of another unbalanced rotor that rotates in an opposite direction.

8. The vibratory unit of claim 7, wherein each of the eccentrically weighted rotary assemblies comprises an offset weight.

9. A down-the hole core barrel vibratory unit, comprising:

a casing comprising a fluid inlet and a fluid outlet positioned therein;

a fluid-driven vibrating mechanism that produces vibrations in a drilling direction without producing any substantial vibrations in a non-drilling direction, the fluid-driven vibratory mechanism including a plurality of rotors having interacting teeth, the rotors each being unbalanced about a central axis and positioned within the casing whereby fluid flowing from the fluid inlet to the fluid outlet and directly across the interacting teeth causes the plurality of rotors to rotate; and a damping mechanism that reduces or eliminates the vibrations before they are transmitted to another part of a drilling system to which the vibrating mechanism is connected.

10. The vibratory unit of claim 9, wherein the fluid flowing through the casing creates dynamic forces in the drilling direction.

11. The vibratory unit of claim 10, wherein an unbalanced rotor comprises an unbalanced section that is placed in diametric opposition to the unbalanced section of another unbalanced rotor that rotates in an opposite direction.

12. The vibratory unit of claim 9, wherein the unbalanced rotors comprise gear rotors.

13. The vibratory unit of claim 12, wherein each of the unbalanced rotors comprises an offset weight.

14. The vibratory unit of claim 9, wherein the damping mechanism damps the vibrations from the vibrating mechanism before the vibrations reach a link latch of the core barrel assembly.

15. A drilling system containing a down-the-hole vibratory unit, the unit comprising:

a casing comprising a fluid inlet and a fluid outlet;

a fluid-driven vibrating mechanism that produces vibrations in a drilling direction without producing any substantial vibrations in a non-drilling direction, the fluid-driven vibratory mechanism including a plurality of rotors having interacting teeth, whereby fluid flowing from the fluid inlet to the fluid outlet and directly across the interacting teeth causes the plurality of rotors to rotate; and a damping mechanism that reduces or eliminates the vibrations before they are transmitted to another part of a drilling system to which the vibrating mechanism is connected.

16. The system of claim 15, wherein the plurality of rotors are unbalanced about a central axis and a fluid flowing through the casing creates dynamic forces in the drilling direction.

17. The system of claim 16, wherein a first rotor of the plurality of rotors comprises an unbalanced section that is placed in diametric opposition to an unbalanced section of another rotor of the plurality of rotors that rotates in an opposite direction to the first rotor.

18. A core-barrel system, comprising:

a core barrel head assembly;

an inner tube; and a vibratory unit containing:

a casing comprising a fluid inlet and a fluid outlet;

a fluid-driven vibrating mechanism that produces vibrations in a drilling direction without producing any substantial vibrations in a non-drilling direction, the fluid-driven vibratory mechanism including a plurality of rotors having interacting teeth, whereby fluid flowing from the fluid inlet to the fluid outlet and directly across the interacting teeth causes the plurality of rotors to rotate; and a damping mechanism that reduces or eliminates the vibrations before they are transmitted to another part of a drilling system to which the vibrating mechanism is connected.

19. The system of claim 18, wherein a fluid flowing through the casing creates dynamic forces in the drilling direction.

20. The system of claim 18, wherein a first rotor of the plurality of rotors comprises an unbalanced section that is placed in diametric opposition to an unbalanced section of another rotor that rotates in an opposite direction to the first rotor.

21. The system of claim 20, wherein the first and another rotors each comprise gear rotors with an offset weight.

22. The system of claim 18, wherein the damping mechanism damps the vibrations from the vibrating mechanism before the vibrations reach a link latch of the core barrel head assembly.

23. A method for drilling, comprising:

providing a vibratory unit containing:

a casing comprising a fluid inlet and a fluid outlet;

a fluid-driven vibrating mechanism that produces vibrations in a drilling direction without producing any substantial vibrations in a non-drilling direction, the fluid-driven vibrating mechanism including a plurality of rotors with interacting teeth; and a damping mechanism that reduces or eliminates the vibrations before they are transmitted to another part of a drilling system to which the vibrating mechanism is connected;

connecting the vibratory unit to a down-the-hole part of a drilling system; and causing fluid to flow through the casing and directly across at least one of the plurality of rotors with interacting teeth thereby generating vibrations in the drilling direction.

24. The method of claim 23, wherein the down-the-hole part of the drilling system comprises a core barrel assembly.

* * * * *